United States Patent [19]

Matthews

[11] Patent Number: 4,570,466

[45] Date of Patent: Feb. 18, 1986

[54] DOOR LOCKING METHODS AND APPARATUS

[75] Inventor: John W. Matthews, Incline Village, Nev.

[73] Assignee: Laser Products Corporation, Fountain Valley, Calif.

[21] Appl. No.: 533,066

[22] Filed: Sep. 9, 1983

[51] Int. Cl.[4] ..... E05B 65/08; E05B 49/00; C14B 1/40

[52] U.S. Cl. ..... 70/99; 70/14; 70/34; 70/279; 70/285; 70/371; 70/470; 70/DIG. 26; 292/150

[58] Field of Search ..... 70/14, 32–34, 70/90, 95–100, 150, 158, 159, 361, 371, 470, 488, DIG. 26, 278, 279, 285; 292/288, 150

[56] References Cited

U.S. PATENT DOCUMENTS

| | | | |
|---|---|---|---|
| 924,331 | 6/1909 | Feola | 70/32 |
| 2,636,762 | 4/1953 | Jameson | 292/150 |
| 3,136,147 | 6/1964 | Noster | 70/90 |
| 3,656,327 | 4/1972 | Ford et al. | 70/150 X |
| 3,733,861 | 5/1973 | Lester | 70/278 X |
| 3,751,088 | 8/1973 | Schlage et al. | 70/279 X |
| 3,956,911 | 5/1976 | Corboud | 70/100 |
| 4,038,846 | 8/1977 | Klann | 70/150 X |
| 4,068,506 | 1/1978 | Phelps | 70/100 |
| 4,099,752 | 7/1978 | Geringer | 70/279 X |
| 4,183,235 | 1/1980 | Coralli et al. | 70/34 |
| 4,351,170 | 9/1982 | Clompus | 70/371 X |

*Primary Examiner*—Robert L. Wolfe
*Assistant Examiner*—Russell W. Illich
*Attorney, Agent, or Firm*—Benoit Law Corporation

[57] ABSTRACT

Methods and apparatus for releasably locking or blocking a door combine a first element with that door for blocking the door in an extended position of that first element and for alternatively releasing the door upon movement of the first element from such extended position. The first element is releasably blocked in its extended position by removably locating a second element in a path of movement of the first element. The door may be locked by locking the first element in its extended position and blocking such locked first element with the second element. The locked first element is released by selectively removing the second element from the path of movement of the first element, and the door is released by moving the released locked first element in its path of movement while the second element is removed from such path of movement. The first element may selectively be unlocked while it is blocked by the second element, and such blocked unlocked first element may be removed for a release of the door. The first element may be provided with an anisometric configuration against movement despite a removal of the second element from the path of movement of the first element. Alternatively, the first element may be permitted in a second orientation at its anisometric configuration to move upon removal of the second element from its path of movement.

21 Claims, 9 Drawing Figures

DOOR LOCKING METHODS AND APPARATUS

BACKGROUND OF THE INVENTION

The subject invention relates to locking methods and apparatus, safekeeping systems, lock boxes, gun lock cabinets and boxes, and to security systems.

Many locking systems for various purposes have become known over the years. By way of example, some automobiles are equipped with a facility for opening the trunk lid from the driver's area by means of a push button located at or near the glove compartment, for operating a solenoid at the trunk lid lock via an electric line. The trunk lid may thus be opened electrically and remotely as an alternative to using the regular trunk lock key.

In the context of security systems, code entry systems, frequently of the keyboard type, are sometimes provided to enable the opening of a door without or in circumvention of a conventional key.

In the storage of valuables, guns and other objects, safes and strongboxes are frequently used to prevent such social ills as theft, abuse, and injury. Sometimes such containers are equipped with high-quality locks having rather elaborate keys. This safeguards the container against picking of the lock, but has the drawback that anyone who finds the key can open the box with no particular effort. Accordingly, the owner of the container will have to establish and continually maintain special precaution to safeguard the key against loss or ready discovery thereof.

This often renders the contents of the box less readily available to the owner than would be desirable, especially when the situation arises that the owner has to have frequent quick access to the contents of the container.

For repeated quick access to the contents of the container, the owner should actually carry the key on his or her person continually. This is, however, not always practical. For instance, carrying keys on one's person is typically impractical where swimsuits and similar recreational clothing is or are worn and where the key needs to be of some complexity to prevent picking of the lock. Also, constantly carrying a key on one's person exposes the key to loss, particularly in active environments, such as hunting lodges, where the locked box may be employed to keep guns against access by children or unauthorized persons.

In these and similar situations, it would be better for the box to have an electronic or coded lock, which the owner could actuate by dialing or keying-in a preset code. That, however, would have the disadvantage that the owner would have to give away the particular code whenever he authorized another person to get a document or object from the locked container. The owner would thus have to change the code rather frequently, in order to retain control over the particular locking facility. Necessitated frequent changes of the code, however, engender the danger of the owner either forgetting what the code is at the moment or of the owner repeatedly having to make written records of the code, thereby increasing the risk of discovery by another.

Also, there is a considerable risk with electically operated locks that electric power failures may bar access to the inside of the locked container. In fact, if a power supply and electric locking system are self-contained in the safe or strongbox, a failure of the electric system may require forceful opening of the safe or strongbox, with resulting damage thereto and jeopardy of its contents.

SUMMARY OF THE INVENTION

It is a general object of this invention to overcome the disadvantages and to meet the needs expressed and implicit in the above background of the invention and in other parts hereof.

It is a germane object of this invention to provide improved locking methods, systems and apparatus.

It is a related object of this invention to provide improved methods and apparatus for releasably blocking a door.

It is also an object of this invention to provide improved safes, strongboxes and other lockable containers.

It is a related object of this invention to increase accessibility while augmenting the security of locking systems.

It is also an object of this invention to combine mechanical key-type and electronic key-board-type locking systems to greatest advantage for authorized users.

Other objects of the invention will become apparent in the further course of this disclosure.

From one aspect thereof, the subject invention resides in a method of releasably blocking a door, comprising, in combination, the steps of combining a first element with a door for blocking the door in an extended position of the first element and for alternatively releasing the door upon movement of the first element from the extended position, releasably blocking the first element in the extended position by removably locating a second element in a path of movement of the first element, locking the door by locking the first element in the extended position and blocking the locked first element with the second element, releasing the locked first element by selectively removing the second element from the path of movement of the first element, releasing the door by moving the released locked first element in the path of movement while the second element is removed from the path of movement of the first element, and subsequently restoring the first element to the extended position and the second element to a location in the path of movement of the first element.

The first element may selectively be unlocked while it is blocked by the second element, and such blocked unlocked first element may be removed for a release of the door. The first element may be provided with an anisometric configuration against movement despite a removal of the second element from the path of movement of the first element. Alternatively, the first element may be permitted in a second orientation at its anisometric configuration to move upon removal of the second element from its path of movement.

From another aspect thereof, the subject invention resides in apparatus for releasably blocking a door, comprising, in combination, a first element at the door for blocking the door in an extended position of the first element and for alternatively releasing the door upon movement of the first element from the extended position, a second element situated at a location in a path of movement of the first element for releasably blocking the first element in the extended position, means for locking the door, including means for locking the first element in the extended position relative to the second element, means for circumventing the locking means, including means coupled to the second element for selectively removing the second element from the path of movement of the first element whereby the locked first element is movable from the extended position for releasing the door, and means for restoring the first element to the extended position and the second element to the location in the path of movement of the first element.

Means may be provided at the first element for selectively stopping that first element against movement in its path of movement despite a removal of the second element from that path of movement. The first element may have an anisometric configuration, and means may be provided at the first element for stopping that first element in a predetermined orientation at its anisometric configuration against movement in its path of movement despite a removal of the second element from that path.

Other aspect of the subject invention will become apparent in the further course of this disclosure, and no limitation to any aspect, object, feature, combination or element is intended by this summary of the invention.

BRIEF DESCRIPTION OF THE DRAWINGS

The subject invention and its various objects and aspects will become more readily apparent from the following detailed description of preferred embodiments thereof, illustrated by way of example in the accompanying drawings, in which like reference numerals designate like or functionally equivalent parts, and in which.

DESCRIPTION OF PREFERRED EMBODIMENTS

Figure 1:
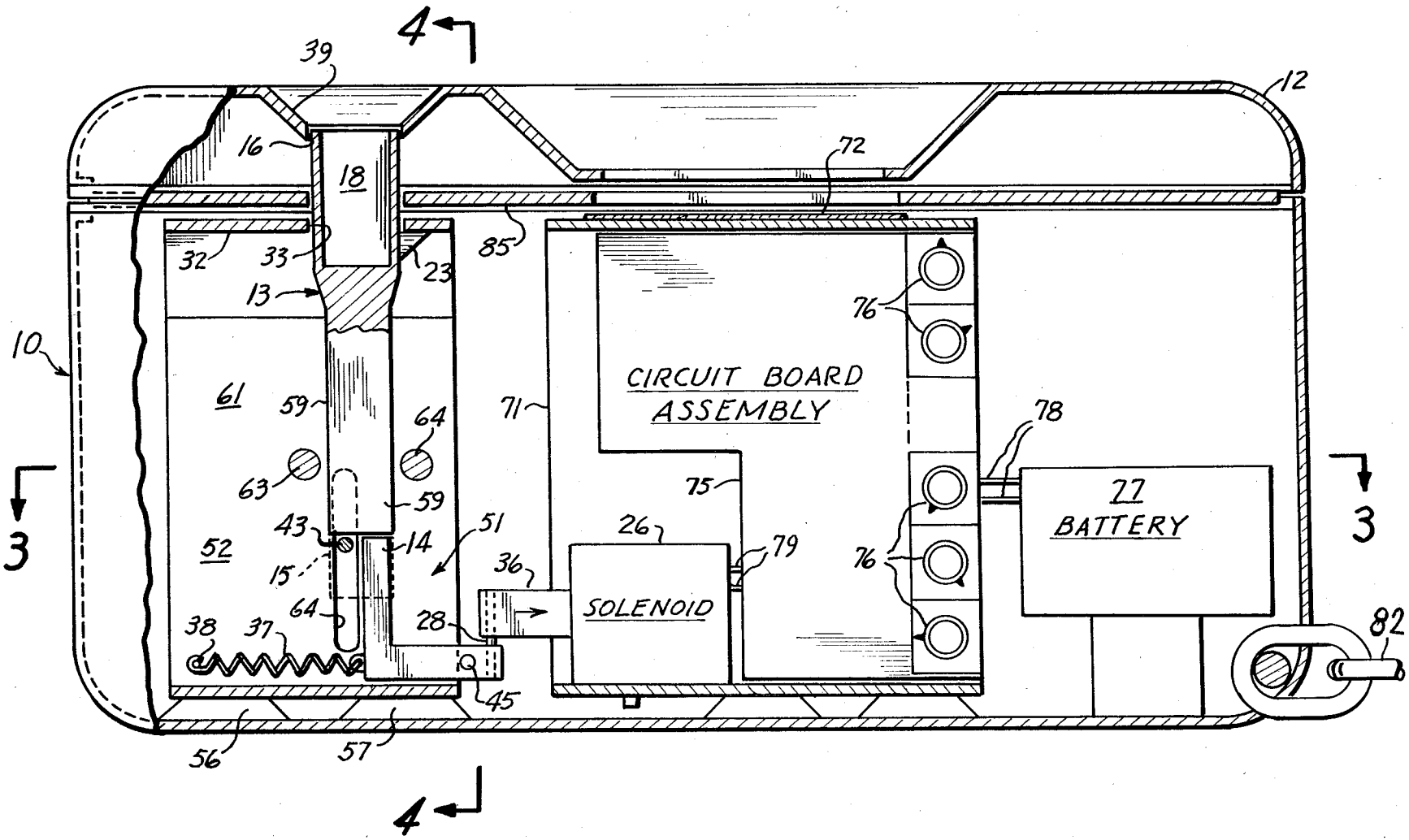
FIG. 1 is a transverse section through a locked container showing a locking system according to a preferred embodiment of the subject invention.
Figure 2:
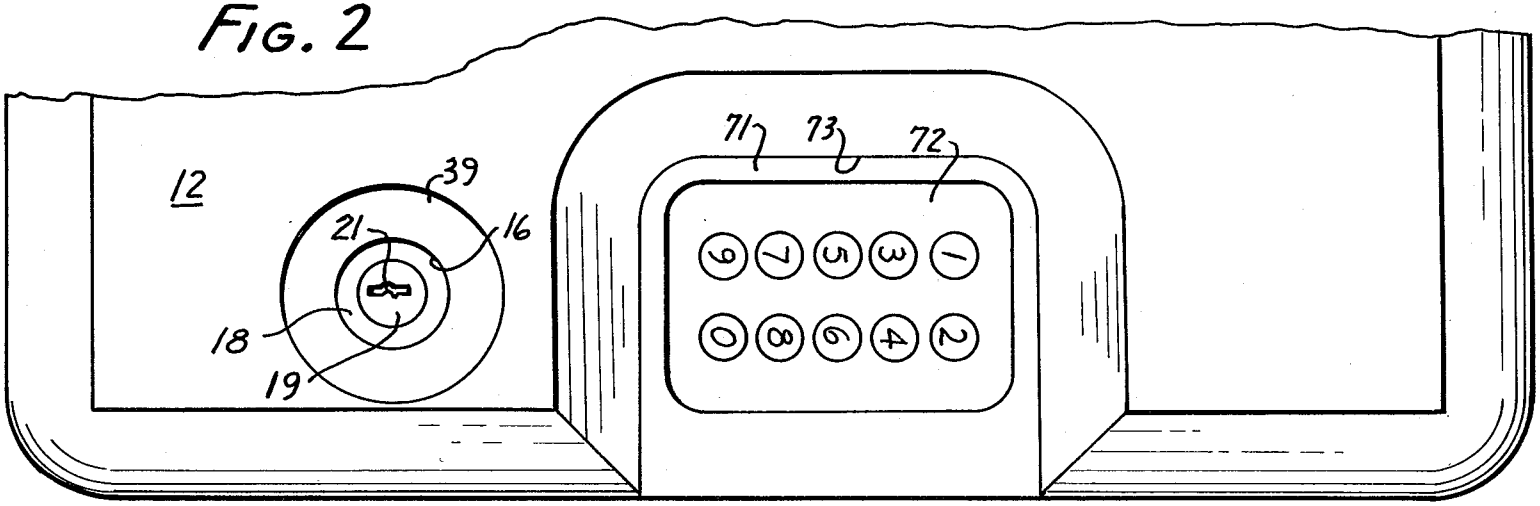
FIG. 2 is a fraction of a top view of the locked container according to FIG. 1.
Figure 3:
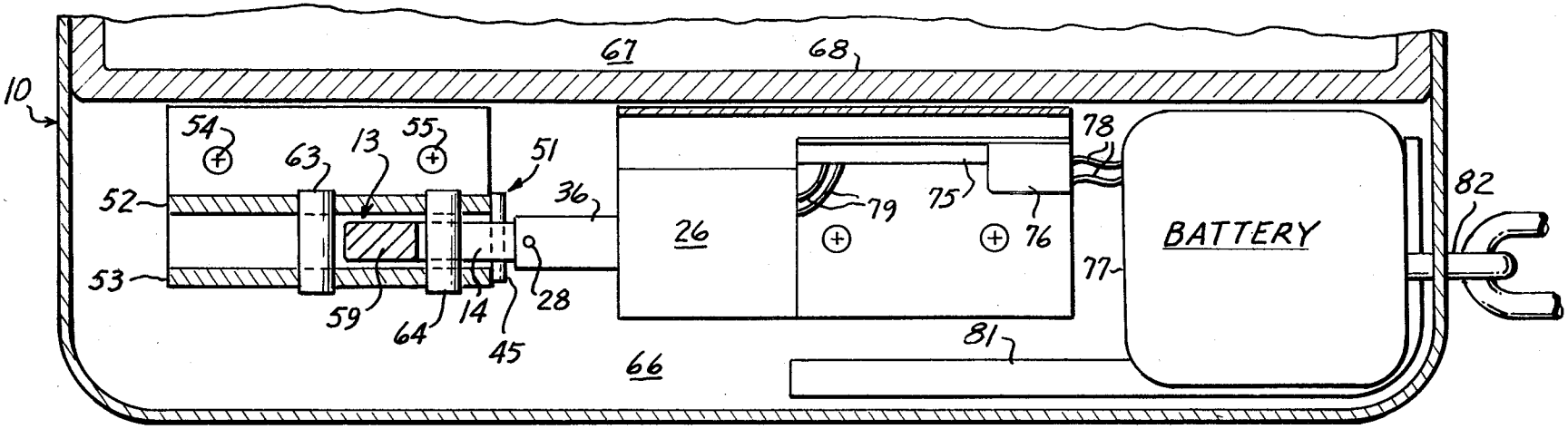
FIG. 3 is a section taken on the line 3—3 in FIG. 1.

The container 10 shown in the drawings has a lid or door 12 which is slidable relative thereto. The door 12 is shown in a closed position preventing access to the container, at least as long as this sliding door 12 is blocked or locked.

A first lock element 13 is located at and combined with the door 12 for blocking such door in the illustrated extended position of that first element and for alternatively releasing the door upon movement of such first element from the illustrated extended position. The first element 13 is releasably blocked in its extended position by removably locating a second element 14 in a path of movement 15 of the first element.

The door 12 is locked by locking the first element 13 in its extended position and blocking the locked first element with the second element 14. In this extended locked position, the top of the first element 13 extends through an aperture 16 in the door 12, thereby preventing the door from sliding relative to the container 10.

By way of example, the first element 13 may have a cylinder lock 18 in its top portion. The cylinder lock 18 has a locking cylinder 19 provided with a keyhole or slot 21.

The lock 18 has a locking element or catch 23 which protrudes laterally from the first element 13 when the lock is in its locked condition.

Figure 4:
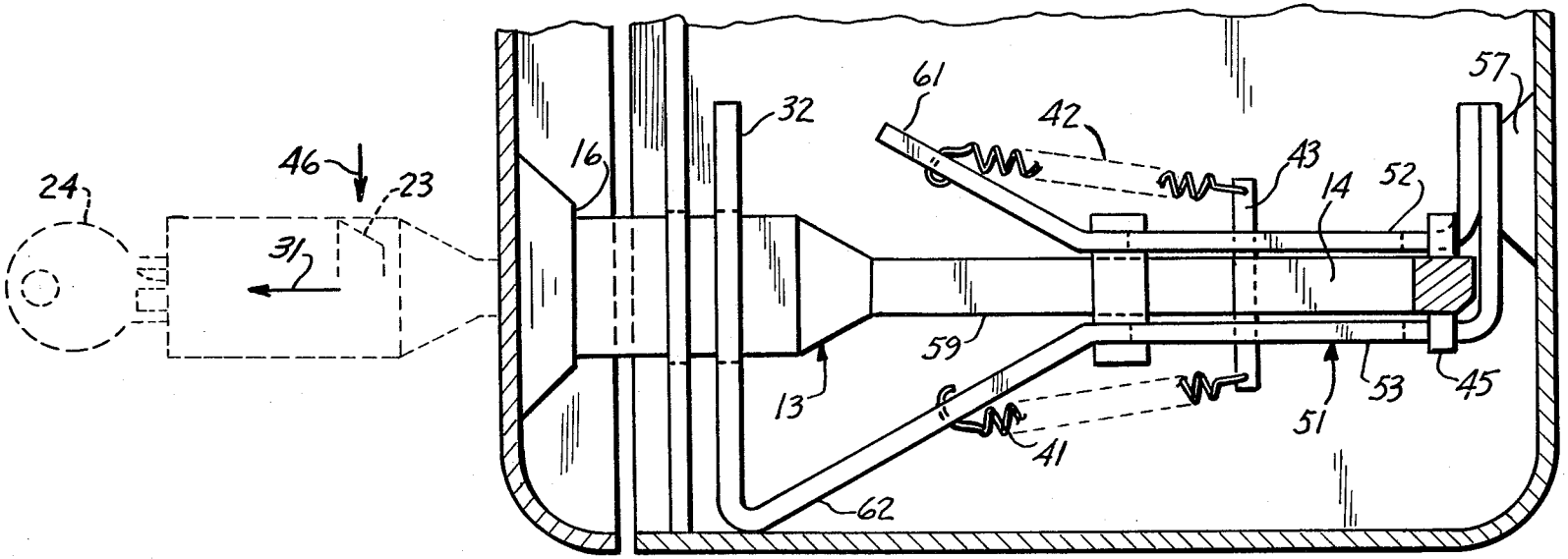
FIG. 4 is a section taken on the line 4—4 in FIG. 1.

An appropriate key 24 is needed to unlock the lock 18 in the sense of a withdrawal of the catch 23 in a retracted position, as shown in dotted outline in FIG. 4.

In many situations, reliance solely on a key for unlocking the container 10 is inconvenient and often not even particularly safe. For one thing, the key 24 should not be readily accessible lest it be easily found by an intruder gaining thereby access to the contents of the container. On the other hand, if the key is well hidden, the owner himself may have trouble finding it.

Wearing the key on the owner's person is not always a reliable solution, especially in a home environment or similar situation where people wear recreational attire and do not constantly carry their keys with them. Accordingly, if the key 24 is maintained at a safe place sufficiently away from the container 10 for easy discovery, then the owner's quick and convenient access to the container is correspondingly hampered.

Therefore, the subject invention provides an alternative for opening the container 10.

Figure 5:
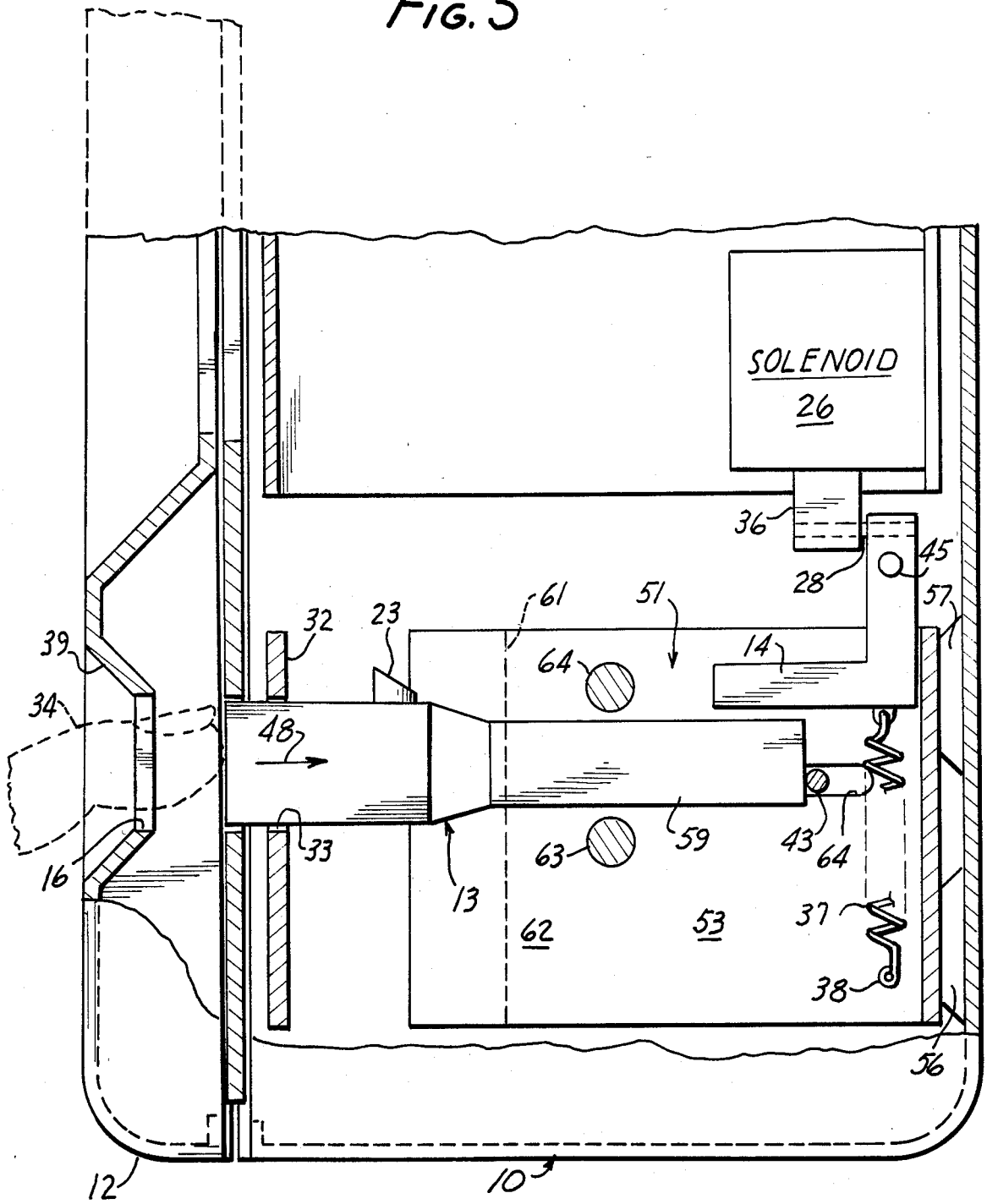
FIG. 5 is a view partially similar to FIG. 1, showing an unlocking operation according to a preferred embodiment of the subject invention.

In particular, the locked first element 13 is released by selectively removing the second element 14 from the path of movement 15 of the first element. As shown in FIG. 5, a solenoid 26 may be employed for this purpose. The disclosed locking system thus includes means for circumventing the locking device 18, including a solenoid 26 coupled to the second lock element 14 by a rod or link 28 for selectively removing the second element from the path of movement 15 of the first element, whereby the locked first element 13 is movable from its extended position shown in FIG. 1 for releasing the door 12.

According to the illustrated preferred embodiment of the subject invention, the first element 13 is locked in its extended position in the door aperture 16 against movement away from the second element 14, or in general terms, against movement in a direction 31, indicated in FIG. 4, which is opposite to the possible direction of movement of the first element 13 in its above mentioned path of movement 15 indicated in FIG. 1.

In order to so lock the first element 13 in its extended position against movement away from the second element 14, the catch or latch 23 reaches under a lock plate 32 adjacent an aperture 33 through which the first element 13 extends to the aperture 16 provided in the door 12. The latch 23 so extends below the lock plate 32 as long as the lock 18 is in its locked condition.

In the case of a sliding door, such as the door 12 slidable in a plane 29, the locked first element 13, extending through that plane 29 or through an aperture 16 in that plane, blocks in its extended position the door 12 against sliding, thereby keeping the container 10 in a locked condition.

In the illustrated preferred embodiment, the first element 13 is made manually engageable through the door aperture 16, such as by a human finger 34. However, as long as the second element 14 is in the path of movement of the first element, that first element 13 is blocked against depression by a finger 34 in the path of movement 15. The container 10 thus remains locked as long as the latch 23 is extended under the lock plate 32 and the second element 14 remains in the path of movement of the first element 13.

Upon energization of the solenoid 26, such as in response to receipt of a predetermined code, the first element 13 is released or unblocked by removal of the second element from the path of movement of the locked first element. In the illustrated preferred embodiment, this is accomplished by the solenoid 26 attracting the plunger 36, thereby moving the angular second element 14 via a link 28 against the bias of a spring 37 anchored at 38.

The thus unblocked locked first element 13 may now be removed from the door aperture 16 to unblock the door 12 for sliding opening movement in the plane 29. At that point, the lock 18 in the first element 13 is still locked in the sense of the latch 23 extending laterally out of the first element 13, thereby catching the lock plate 32. However, the unblocked first element 13 may now be manually engaged, such as by means of the finger 34 shown in FIG. 5, and may thus be depressed out of the door aperture 16 from its extended position, to unblock the door 12 for sliding movement in the plane 29. Broadly speaking, it may be said that the first element 13 is rendered manually engageable through the door aperture at 16, which in the illustrated embodiment has a tapered or conical upward extension 38.

The door 12 and thereby the container 10 may thus be opened past the depressed first element 13 in circumvention of the lock 18 and extended latch 23 or, broadly speaking, in circumvention of the first element 13.

After the desired access to the contents of the container 10 has been had and the door 12 has been reclosed, the door or container may be locked again with the first element 13. In particular, the first element 13 may be restored to its extended position and the second element 14 to its extended location in the path of movement 15 of the first element. Bias springs 41 and 42 may be employed for restoring the first element to its extended position via a yoke or pin 43 supporting and biasing the first element 13. Similarly, the spring 37 is employed for biasing the second element 14 to its extended position in the path of movement 15 of the first element. A pin 45 is employed to limit the travel of the second element 14 in the direction of the bias spring 37 beyond the desired extended position of the second element 14, shown in FIG. 1.

If the solenoid 26 is not actuated, the second element 14 remains in the path of movement 15 of the first element, thereby blocking the first element against release from its extended position in the door aperture 16. On the other hand, the door 12 may, nevertheless, be released by movement of the first element 13 from its extended position in a direction 31 away from the second element 14, as indicated in dotted outline in FIG. 4. In particular, the key 24 may be inserted into the lock 18 and may be turned in order to withdraw the latch 23 in the direction of an arrow 46 into the first element 13. This permits the bias springs 41 and 42 and yoke pin 43 to push the first element 13 partially out of the aperture 16 and its extension 39, with the inwardly withdrawn latch 23 sliding through the aperture 33 in the lock plate 32.

The popped-out first element may thus be manually engaged at the lock portion 18 and may be removed from the door and container altogether, whereby access to the container 10 is readily obtained by sliding the door 12 in the plane 29.

After the desired access to the container 10 has been had, the door 12 may be reclosed by bringing the apertures 16 and 33 into spatial coincidence with each other, whereby the removed first element 13 may be reinserted through apertures 16 and 33, until the first element 13 comes to rest on the second element 14 in the extended positions of both these first and second elements.

The door may thus be locked or relocked by locking the first element 13 in its extended position against movement away from the second element 14, while blocking the first element with such second element. The latch 23 has a slanted surface as, for instance, seen in FIG. 1, whereby it may be inserted through apertures 16 and 33 so as to assume its extended position below the lock plate 32. Of course, the key 24 may also be employed for extending the latch 23, depending on the construction of the lock 18.

In this respect, the lock 18 may be of a conventional design, having a latch 23 with its retractable by rotation of a key 24 and which is either extensible by a further or counterrotation of the key, or which snaps back to its extended position under the influence of an internal spring, all as well known in the art of locks and locking devices.

In this or any equivalent manner, the locked first element 13 may be selectively unlocked while being blocked by the second element 14, and such blocked unlocked first element may be removed in a direction 31 for a release of the door 12.

Summarizing certain features of the illustrated preferred embodiment, there is provided an aperture 16 in the door 12. The first element 13 is extended into that aperture in an extended position thereof to block the door 12. The first element 13 is locked in that extended position in the aperture 16 against movement away from the second element 14. As shown in FIG. 1, the extended lock latch 23 may be employed for this purpose.

The first element 13 may then be selectively unblocked by removing the second element 14 from the path of movement 15 of the blocked first element, such as by means of the solenoid 26. The unblocked locked first element 13 may then be removed from the door aperture 16 in a first direction 48, such as by manual depression through the aperture 16 with a human finger 34, when or while the second element 14 is removed from the path of movement 15.

After the door 12 has thus been unblocked and presumably opened and subsequently reclosed, the locked first element 13 may be restored, such as by means of bias springs 41 and 43 and yoke pin 43, to its extended position in the aperture 16 to block the door 12.

Subsequently, the door 12 may be unblocked by unlocking the first element 13, such as by withdrawal of the latch 23 with the inserted key 24, and by removing such unlocked first element through the aperture 16 in a direction away from the second element or, more specifically, in a second direction 31 shown in FIG. 4, opposite to the first direction 48 shown in FIG. 5.

As shown in the drawings, the key lock circumventing system 51 includes a pair of partially parallel plates 52 and 53 mounted by fasteners 54 and 55 on pads 56 and 57, respectively.

The plates 52 and 53 are spaced to receive therebetween a rectangular lower portion 59 of the first element and do thereby retain that first element 13 against rotation in the door aperture 16 and lock plate aperture 33. Guide plate extensions 61 and 62 of the plates 52 and 53 and pins or dowels 63 and 64 assist a correct insertion of the first element through the apertures 16 and 33 into the structure.

As seen in FIG. 4, the locking plate 32, like the guiding plate 62, may also be formed of the plate 53. Moreover, guide plates 61 and 62 may serve as anchors for the bias strings 41 and 42. The yoke pin 43 biased by those springs extends through two parallel elongate slots in the plates 52 and 53. FIGS. 1 and 5 partially show one of these slots 64 in the plate 52.

The slot 64, as well as its counterpart in the plate 53, extends sufficiently downwardly to permit depression of the first element 13 as seen in FIG. 5 when the second element 14 has been removed from the path of movement 15, as well as sufficiently upwardly to permit the bias springs 41 and 42 to project the first element 13 partially out of the door aperture 16, when the latch 23 has been withdrawn as seen in FIG. 4, by rotation of the inserted key 24.

The locking and lock circumvention structure 51 may be located in a secondary or side compartment 66 of the container 10, separated from the main compartment 67 by a steel enclosure 68. That compartment 66 may also contain a frame 71 for mounting the solenoid 26 at a lower portion and a code entry keyboard 72 on top thereof. The keyboard 72 is accessible through an aperture 73 in the door 12. A circuit board assembly 75 is preferably mounted in the frame 71. Potentiometers 76 or similar devices are mounted on the frame 71 or circuit board assembly 75, in order to permit variation of the requisite code upon removal or opening of the door 12 from or on the container 10. Code setting devices 76 are well known in the art of coded locking systems, as are keyboard entry devices 72 and their associated circuitry 75. A battery or other power supply 77 may be located in the compartment 66 for energization of the circuitry 75 and solenoid 26 via supply wires 78.

Leads 79 may be employed for energizing the solenoid 26 when the correct preset combination has been entered through the keyboard 72.

Also located in the secondary compartment 66 is a bent chain restrain rod 81 having attached thereto a chain 82 for preventing an unauthorized removal of the container 10.

The code entry facility 72 and associated lock circumvention system 51 provide the owner with an alternative to the use of the key 24. The owner can thus store the key in a safe place while gaining repeated convenient access to the container 10 through the memorized code. The requisite code may be changed by the owner by means of the potentiometers or equivalent devices 76.

However, this will only rarely be necessary, since the owner need not reveal the code to a person whom he or she wishes to have temporary access to the container. Rather, if the owner, for instance, wants a person to fetch an object from the container, he or she can give such person the key 24 for that purpose, without revealing the code entered at 76.

On the other hand, in instances where a delegee cannot be entirely trusted against duplication of a key, the owner has the flexibility of revealing to such person the code for brief access to the container, and of thereafter resetting such code at 76.

In practice, this brings up an interesting point. While it is relatively easy for the owner to change the code, it is frequently more difficult to retrieve a key, let alone to prevent unauthorized duplication of a key or to locate any duplicated key. In these and other instances, the owner may find it more advantageous to give out the code, while retaining the key in his possession. According to a preferred embodiment of the subject invention, the owner has the flexibility of selectively preventing access to the contents of the locked container, even if others have been given knowledge of the code applicable at the time.

In this respect, FIGS. 6 to 9 show a modification of the embodiment illustrated in FIGS. 1 to 5. In particular, FIGS. 6 to 9 show a modified first element 81 which may take the place of the above mentioned element 13 in the container structure 10.

Figure 8:
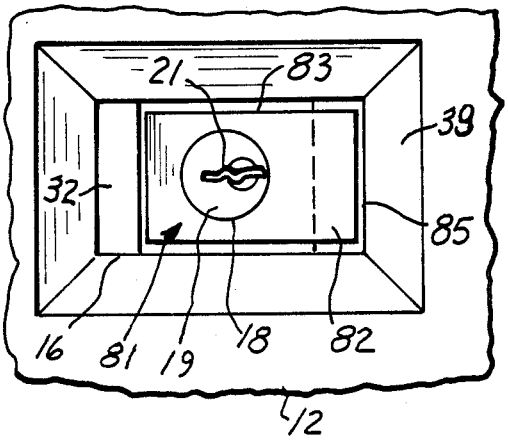
Figure 9:
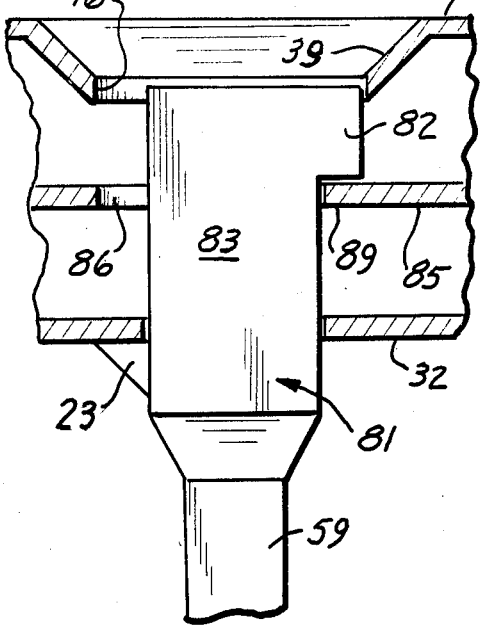

In the preferred embodiment illustrated in FIGS. 6 to 9, the modified first element 81 has a lateral projection 82. The modified first element 81 also has a rectangular top or head 83. However, this is not essential as long as the modified first element has a lateral projection 82 or is otherwise provided with an anisometric configuration. As seen in FIGS. 8 and 9, an apertured plate 85 stops the first element in a first orientation of such first element 81 at the anisometric configuration or projection 82 against movement in the above mentioned path of movement 15 of the first element, despite a removal of the above mentioned second element 14 from such path of movement, such as by action of the solenoid 26 as shown in FIG. 5.

Alternatively, the illustrated preferred embodiment of the invention permits the first element in a second orientation of such element 81 at the anisometric configuration or projection 82 to move in the path of movement 15 upon removal of the second element 14 from such path of movement, such as shown in FIG. 5 and disclosed above. To this end, the plate 85 has an aperture 86 corresponding to the anisometric configuration of the modified first element 81. As shown in FIG. 7, the aperture 81 is laterally extended so that the projection 82 can pass therethrough when such projection or anisometric configuration is in its second orientation shown in FIGS. 6 and 7.

As in the embodiment of FIGS. 1 to 5, a preferred method provides a code and then selectively removes the second element 14 from the path of movement 15 of the first element in response to such code or its receipt via the code entry facility 72.

However, unlike the embodiment shown in FIGS. 1 to 5, the embodiment shown in FIGS. 6 to 9 has a specific facility for selectively stopping the first element against movement in the path of movement 15 despite a removal of the second element 14 from such path of movement. According to the preferred embodiment illustrated in FIGS. 6 to 9, such facility resides in the anisometric configuration of the modified first element 81 at 82 and of the correspondingly anisometric configuration of the aperture 86.

According to a preferred aspect thereof, the subject invention provides a lock for a door with a first element 81 for selectively blocking and unblocking the door and provides such lock with a facility, such as a locking mechanism 18 and 19, for selectively locking the element 81 against an unblocking of the door, such as by means of the catch 23. A code is again provided or received, such as by means of the above mentioned code entry and setting devices 72 and 76 and associated circuitry 75.

The currently discussed aspect of the invention also provides means, such as a solenoid 26 connected to the code receiving means and the second element 14 coupled to the lock for enabling unblocking of the door in response to receipt of the code, despite the locking of the first element 81 by means of the locking mechanism 18 and 19 with catch 23. As disclosed above, the subject invention thus provides the lock with a second element 14 for enabling unblocking of the door in response to receipt of a code, despite the mentioned blocking of the first element, such as by the mechanism 18, 19 and 23.

According to the currently discussed aspect thereof, the subject invention selectively limits an unblocking of the door to an unlocking through the locking mechanism or facility 18, 19 and 23, despite any receipt of the code. In this or any equivalent manner, the currently discussed aspect of the invention limits the first element 81 to removal only upon its unlocking, such as by means of the inserted key, as shown in dotted outline in FIG. 4. It is thus a specific feature of the preferred embodiment shown in FIGS. 6 to 9 that the first element 81 can always be removed by means of the key 24 in any orientation of the first element 81, such as the orientation shown in FIGS. 6 and 7 and the opposite orientation shown in FIGS. 8 and 9.

As the first element 13, the modified element 81 may have a rectangular lower portion 59 interacting with adjacent components as shown in FIGS. 1 to 5, for instance. In that case, entry of a code at 72 will cause the solenoid 26 to remove the second element 14 from the path 15 of the first element. If such element is oriented with its projection 82 in the direction shown in FIGS. 6 and 7, it can be depressed downwardly in the direction of the arrow 48 since the lateral projection 82 can move through the lateral extension of the opening 86 to the position shown in dotted outline at 88. Accordingly, in the orientation shown in FIGS. 6 and 7 at the anisometric configuration 82, the modified element 81 can be depressed by a human finger 34 as already shown for the first element 13 in FIG. 5, in response to receipt of a code.

On the other hand, the unblocking of the door may readily be limited by the first orientation of the first element at the anisometric configuration or projection 82, as shown in FIGS. 8 and 9, to an unblocking upon an unlocking of the first element 81 via the locking mechanism or facility 18 and 19 and 23. In the illustrated embodiment shown in FIGS. 8 and 9, such limitation of an unblocking to key-operated removal is brought about by an appropriate relative orientation or positioning of the projection 82 and opening 86, whereby a part 89 of the plate 82 is in the way of the latter projection 82, thereby effectively inhibiting downward movement of the element 81 by means of a human finger 34 or otherwise, even when a received code has effected removal of the second element 14 from the path of movement 15 of the first element 81.

The owner of the key 24 is thus able to perform two important control functions. First of all, by using the key in the slot 21, the owner can remove the modified first element 81 and reinsert it in either of the positions shown in FIGS. 6 and 7 on the one hand and FIGS. 8 and 9 on the other. In this manner, the owner of the key can control whether access to the container is to be limited to access by the key 24 only, or is alternatively to be extended to access by a code entered through the facility 72 as well.

Secondly, if the modified first element 81 has been inserted in the manner shown in FIGS. 8 and 9, then only the owner of the key can gain access to the container, and possession of the code is then of no avail.

Figure 6:
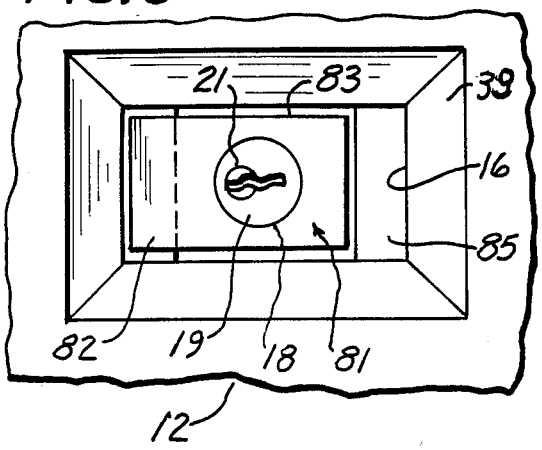
FIGS. 6 to 9 are detail top and side views, respectively, of a modification of the embodiment of FIGS. 1 to 5, according to a further preferred embodiment of the subject invention.
Figure 7:
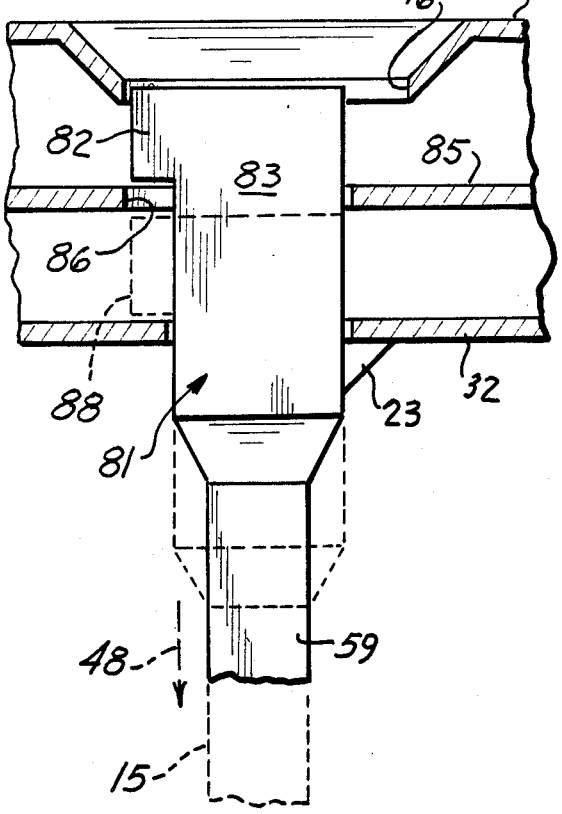

On the other hand, the owner of the key can always enable access by the code as well, such as by removing and thereupon reinserting the first element 81 in its second orientation shown in FIGS. 6 and 7. This then selectively enables an unblocking of the door in response to receipt of the code and an unblocking of the door upon the unlocking of the first element 81 with the key 24.

Various modifications and variations within the spirit and scope of the subject invention are rendered apparent or suggested to those skilled in the art by the subject extensive disclosure.

I claim:

1. A method of releasably blocking a door, comprising in combination the steps of:

combining a first element with said door for blocking said door in an extended position of said first element and for alternatively releasing said door upon movement of said first element from said extended position;

releasably blocking said first element in said extended position by removably locating a second element in a path of movement of said first element;

locking said door by locking said first element in said extended position and blocking said locked first element with said second element;

releasing said locked first element by selectively removing said second element from said path of movement of said first element;

releasing said door by moving said released locked first element in said path of movement while said second element is moved from said path of movement of said first element;

subsequently restoring said first element to said extended position and said second element to a location in said path of movement of said first element;

selectively unlocking said first element while said first element is blocked by said second element; and removing said blocked unlocked first element for a release of said door.

2. A method as claimed in claim 1, including the steps of:

providing an aperture in said door;

extending said first element into said aperture in said extended position to block said door;

locking said said first element in said extended position in said aperture against movement away from said second element;

selectively unblocking said first element by removing said second element from said path of movement of said locked first element; and selectively removing said first unblocked locked element from said aperture to unblock said door.

3. A method as claimed in claim 1, including the steps of:

rendering said door slidable in a plane;

providing said door with an aperture extending through said plane;

extending said first element into said aperture in said extended position to block said door against sliding;

locking said first element in said extended position in said aperture against movement away from said second element;

selectively unblocking said first element by removing said second element from said path of movement of said locked first element; and selectively removing said unblocked locked first element from said aperture to unblock said door for sliding in said plane.

4. A method as claimed in claim 1, including the steps of:

rendering said door slidable in a plane;

providing said door with an aperture extending through said plane;

rendering said first element manually engageable through said aperture;

extending said first element into said aperture in said extended position to block said door against sliding; and manually engaging said first element through said aperture and depressing said first element out of said aperture from said extended position to unblock said door for sliding in said plane.

5. A method as claimed in claim 1, including the steps of:

releasing said door by movement of said first element from said extended position in a direction away from said second element; and locking said door by locking said first element in said extended position against movement away from said second element while blocking said first element with said second element.

6. A method as claimed in claim 1, including the step of:

selectively limiting said first element to removal only upon said unlocking.

7. A method as claimed in claim 1, including the steps of:

providing a code; and selectively removing said second element from said path of movement of said first element in response to said code.

8. A method of releasably blocking a door, including the steps of:

providing an aperture in said door;

combining a first element with said door for blocking said door in an extended position of said first element and for alternatively releasing said door upon movement of said first element from said extended position;

releasably blocking said first element in said extended position by removably locating a second element in a path of movement of said first element;

locking said door by locking said first element in said extended position in said aperture against movement away from said second element and blocking said locked first element with said second element;

releasing said locked first element by selectively removing said second element from said path of movement of said first element;

releasing said door by moving said released locked first element in said path of movement while said second element is removed from said path of movement of said first element;

selectively stopping said first element against movement in said path of movement despite a removal of said second element from said path of movement;

subsequently restoring said first element to said extended position and said second element to a location in said path of movement of said first element; and subsequently unblocking said door by unlocking said first element and removing said unlocked first element through said aperture in a direction away from said second element.

9. A method as claimed in claim 8, including the step of:

subsequently restoring said first element to movement in said path of movement upon removal of said second element from said path of movement.

10. A method of releasably blocking a door, comprising in combination the steps of:

combining a first element with said door for blocking said door in an extended position of said first element and for alternatively releasing said door upon movement of said first element from said extended position;

releasably blocking said first element in said extended position by removably locating a second element in a path of movement of said first element;

locking said door by locking said first element in said extended position and blocking said locked first element with said second element;

releasing said locked first element by selectively removing said second element from said path of movement of said first element;

releasing said door by moving said released locked first element in said path of movement while said second element is removed from said path of movement of said first element;

subsequently restoring said first element to said extended position and said second element to a location in said path of movement of said first element;

providing said first element with an anisometric configuration against movement in said path of movement despite a removal of said second element from said path of movement, and alternatively permitting said first element in a second orientation of said first element at said anisometric configuration to move in said path of movement upon removal of said second element from said path of movement.

11. In a method of releasably blocking a door, the improvement comprising in combination the steps of:

providing a lock for said door with a first element for selectively blocking and unblocking said door;

providing said lock with a facility for selectively locking said first element against an unblocking of said door;

providing said lock with a second element for enabling unblocking of said door in response to receipt of a code, despite said locking of the first element; and selectively limiting an unblocking of said door to an unlocking through said facility, despite any receipt of said code.

12. A method as claimed in claim 11, including the steps of:

providing said first element with an anisometric configuration;

selectively limiting by a first orientation of said first element at said anisometric configuration an unblocking of said door to an unblocking upon an unlocking of said first element via said facility; and selectively enabling by a second orientation of said first element both said unblocking of the door in response to receipt of said code and said unblocking upon said unlocking of the first element.

13. Apparatus for releasably blocking a door, comprising in combination:

a first element at said door for blocking said door in an extended position of said first element and for alternatively releasing said door upon movement of said first element from said extended position;

a second element situated at a location in a path of movement of said first element for releasably blocking said first element in said extended position;

means for locking said door, including means for locking said first element in said extended position relative to said second element;

means for circumventing said locking means, including means coupled to said second element for selectively removing said second element from said path of movement of said first element whereby said locked first element is movable from said extended position for releasing said door;

means for restoring said first element to said extended position and said second element to said location in the path of movement of said first element; and means at said first element for selectively stopping said first element against movement in said path of movement despite a removal of said second element from said path of movement.

14. Apparatus as claimed in claim 13, wherein:

said first element extends in an aperture in said door;

said locking means include means for locking said first element in said aperture; and said circumventing means include means for selectively removing said second element from said path of movement of said first element so that said locked first element is removable from said aperture.

15. Apparatus as claimed in claim 13, including:

means for rendering said door slidable in a plane;

said door having an aperture extending through said plane;

said first element extending into said aperture in said extended position of the first element;

said locking means include means for locking said first element in said aperture; and said circumventing means include means for selectively removing said second element from said path of movement of said first element so that said locked first element is removable from said first aperture for sliding motion of said door.

16. Apparatus as claimed in claim 13, including:

means for rendering said door slidable in a plane;

said door having an aperture extending through said plane;

said first element extending into said aperture in said extended position of the first element and being adapted to be manually engageable through said aperture; and said apparatus including means for mounting said manually engageable first element for manual depression through said aperture when said second element is removed from said path of movement.

17. Apparatus as claimed in claim 13, including:

means for receiving a code; and means connected to said receiving means and coupled to said second element for removing said second element from said path of movement of the first element in response to said code.

18. Apparatus for releasably blocking a door, comprising in combination:

a first element at said door for blocking said door in an extended position of said first element and for alternatively releasing said door upon movement of said first element from said extended position, said first element having an anisometric configuration;

a second element situated at a location in a path of movement of said first element for releasably blocking said first element in said extended position;

means for locking said door, including means for locking said first element in said extended position relative to said second element;

means for circumventing said locking means, including means coupled to said second element from said path of movement of said first element whereby said locked first element is movable from said extended position for releasing said door;

means at said first element for stopping said first element in a predetermined orientation of said first element at said anisometric configuration against movement in said path of movement despite a removal of said second element from said path of movement; and means for restoring said first element to said extended position and said second element to said location in the path of movement of said first element.

19. Apparatus as claimed in claim 18, including:

means at said first element for permitting said first element in a second orientation of said first element at said anisometric configuration to move in said path of movement upon removal of said second element from said path of movement.

20. In apparatus for releasably blocking a door, the improvement comprising in combination:

a lock for said door having an element for selectively blocking and unblocking said door;

a locking mechanism for selectively locking said element against an unblocking of said door;

means for receiving a code;

means connected to said receiving means and coupled to said lock for enabling unblocking of said door in response to receipt of said code, despite said locking of said element with said locking mechanism; and means for selectively limiting an unblocking of said door to an unlocking through said locking mechanism, despite any receipt of said code, including an anisometric configuration of said element and means at said anisometric configuration for limiting in a first orientation of said element at said anisometric configuration an unblocking of said door to an unblocking through said locking mechanism.

21. Apparatus as claimed in claim 20, including:

means at said anisometric configuration for permitting in a second orientation of said element at said unblocking of said door in response to receipt of said code.

* * * * *